United States Patent [19]

Ikura et al.

[11] Patent Number: 4,935,036

[45] Date of Patent: Jun. 19, 1990

[54] FLASH HYDROPYROLYSIS OF BITUMINOUS COAL

[75] Inventors: Michio Ikura, Kanata; Anthony J. Last, Oakville, both of Canada

[73] Assignee: Energy, Mines and Resources - Canada, Ottawa, Canada

[21] Appl. No.: 209,983

[22] Filed: Jun. 22, 1988

[51] Int. Cl.[5] ..... C10L 9/00; C10G 1/00

[52] U.S. Cl. ..... 44/620; 44/503; 44/504; 201/9; 208/426

[58] Field of Search ..... 44/503, 504, 600, 608, 44/620; 201/9, 42; 208/426

[56] References Cited

U.S. PATENT DOCUMENTS

| | | | |
|---|---|---|---|
| 1,659,695 | 2/1928 | Kitchen | 44/503 |
| 1,775,323 | 9/1930 | Runge | 201/9 |
| 1,838,882 | 12/1931 | Trent | 201/9 |
| 2,359,581 | 10/1944 | Porter | 201/42 |
| 2,534,051 | 12/1950 | Nelson | 201/42 |
| 2,640,016 | 5/1953 | Martin | 201/42 |
| 2,861,028 | 11/1958 | Jenkner | 201/9 |
| 2,877,163 | 3/1959 | Boyer | 201/42 |
| 3,047,472 | 7/1962 | Gorin et al. | 201/9 |
| 3,933,443 | 1/1976 | Lohrmann | 44/504 |
| 3,988,236 | 10/1976 | Albright et al. | 208/426 |
| 4,259,083 | 3/1981 | Ignasiak | 44/620 |
| 4,278,442 | 7/1981 | Matsuda et al. | 44/620 |
| 4,280,876 | 7/1981 | Green et al. | 201/9 |
| 4,309,270 | 1/1982 | Tyler et al. | 208/426 |

FOREIGN PATENT DOCUMENTS

| | | | |
|---|---|---|---|
| 135895 | 8/1982 | Japan | 44/604 |
| 187336 | 10/1922 | United Kingdom | 201/9 |

*Primary Examiner*—Carl F. Dees

[57] ABSTRACT

A process is described for the flash pyrolysis of a high rank caking coal in a pyrolysis chamber in which the coal passes through a tacky state during flash pyrolysis. According to the novel feature, before entering the pyrolysis chamber, the particles of high rank caking coal are blended with a diluent comprising a finely ground non-caking coal, whereby agglomeration and caking of the high rank coal is prevented during flash pyrolysis.

10 Claims, No Drawings

FLASH HYDROPYROLYSIS OF BITUMINOUS COAL

BACKGROUND OF THE INVENTION

This invention relates to the flash hydropyrolysis of high ranking caking (agglomerating) coals, such as bituminous coal, to produce gaseous, liquid and solid decomposition products. More particularly, it relates to a process in which high rank caking coals can be flash hydropyrolyzed in a tubular reactor or a fluidized bed reactor.

Pyrolysis or carbonization of coal and other carbonaceous solids is a well-established technique. It comprises heating carbonaceous material to temperatures at which thermal decomposition occurs with the formation of condensible organic liquids, non-condensible gases and solid residue. The condensible organic liquids obtained are normally referred to as tars and light oils, while the solid residue is normally referred to as char. The tar as produced by the process can be further refined with hydrogen to produce a range of liquid fuel products.

The total yields of tar and liquid hydrocarbons from pyrolysis of coal and other carbonaceous material are markedly influenced by pyrolysis conditions such as heating rate, temperature and residence time of the liberated volatiles and coal particles in the pyrolysis zone. When coal is subjected to rapid or flash pyrolysis followed by rapid quenching of the volatile products, the yields of liquids from the process are maximized and secondary decomposition of the tar product is minimized. This concept of flash pyrolysis has been widely accepted as a carbonization technique for the production of oil from coal.

Flash hydropyrolysis must be carried out at very high heating rates of the coal particles and also with very low residence time of the volatiles in the pyrolysis zone. These conditions are readily met by processing finely divided coal particles in either a fluidized bed or entrained flow reactor.

Problems are experienced when caking coals, e.g. bituminous coals, are used in flash pyrolyzers because it is necessary to take the coal particles through a temperature range at which they become plastic, and in which stage the coal particles tend to agglomerate or cake, before good yields of volatiles are obtained. With caking coals, severe build up of caked or agglomerated char can occur in the pyrolyzer or the product outlet lines, or in both. These caked or agglomerated char deposits can adversely affect the operating characteristics of the pyrolyzer and can ultimately render the process inoperable.

Various techniques have been proposed for overcoming or reducing the problems experienced with agglomerating or caking coals. For instance, the caking carbonaceous material may be mixed with non-agglomerating materials such as hot char. One such process is described in Sass et al., U.S. Pat. No. 3,736,233. However, when the caking coal particles are diluted by mixing them with non-agglomerating solid material, such as char, the quantity of recycled char required is excessively large when this material is derived from an external source, and internal recycling of char or other inert material introduces an additional hot surface which enhances the cracking reactions with a resultant loss in char yield. Moreover, the use of a large amount of inert materialreduces the reactor efficiency by occupying a significant portion of the effective reactor volume.

It is an object of the present invention to provide a new and simplified technique for overcoming the agglomeration or caking problems associated with the flash pyrolysis of caking coals.

SUMMARY OF THE INVENTION

According to the invention there is provided a continuous process for the pyrolysis of high rank agglomerative or caking coals, such as bituminous coals, in which the coal passes through a tacky state during pyrolysis without forming deposits thereof on the reactor walls. In the present invention, the agglomeration problems associated with the tacky state are avoided by mixing the high rank caking coal with a finely ground low rank non-caking coal, such as partially oxidized coal, subbituminous coal and lignites, to prevent agglomeration and caking of the high rank coals during the flash pyrolysis.

The non-caking coal should be ground to a very fine particle size of typically less than 40 microns and preferably less than 10 microns. The effective concentration of non-caking coal diluent depends on the swelling index, the wetability of the diluent by tarry substances that exude from the caking coal particles, and the relative particle diameter of the caking coal to that of the diluent.

For use in the process of this invention, the particle size of the high rank caking coal can vary quite widely, e.g. from about −35 mesh to +150 mesh (Canada standard sieve).

The blend of caking coal and non-caking coal typically contains about 10 to 50%, preferably 20 to 50%, by weight of the non-caking coal and it may also include a small amount, e.g. in the range of about 1 to 5% by weight, of a finely divided inert material, such as silica powder. This aids in the inhibition of caking.

In the method of the present invention, the above mixture is fed into a tubular or fluidized bed flash pyrolyzer at a temperature in the range of about 500° C. to 950° C. and a pressure of at least 4.0 MPa. Preferably the temperature is maintained at a level above 600° C. with a retention time of coal in the reaction zone of under 10 seconds.

Many different materials were tried as diluent for caking coals for instance, lime and Prince Mine char were tested as diluents at particle sizes of less than 10 microns. Even though the lime and char were very finely divided, their surface properties were such that caking could not be reduced substantially during flash hydropyrolysis.

DESCRIPTION OF THE PREFERRED EMBODIMENTS

The following examples are illustrative of the concept of this invention, demonstrating the method of preventing agglomeration of coal during flash hyropyrolysis.

EXAMPLE 1

A series of experiments were carried out to determine the effectiveness of various diluents as caking inhibitors. As bituminous coals for these experiments there were used Prince Mine bituminous coal (PMC) and Lingan bituminous coal (LC). Both coals were ground to less than 60 mesh (less than 250 microns) before being mixed with diluents. The diluents used were Forrestburg subbituminous coal (FC), Prince Mine coal char lime and Cab-O-Sil (trade mark for extremely fine silica sold by Cabott Corp.). The Forrestburg sub-bituminous coal was ground to less than 40 microns particle size and to less than 10 microns particle size for different tests. The lime and Prince Mine char were ground to less than 10 microns particle size, while the Cab-O-Sil had a particle size of less than 1 micron.

Different amounts of diluent between 3% and 65% by weight were mixed with the bituminous coal samples and the mixtures then served as feed stocks to a tubular flash pyrolyzer. These were subjected to a temperature of 700° C., for 2.5 minutes.

The results obtained from hot pour tests are shown in Table 1 below.

TABLE I

Hot Pour Tests

| Coal | Diluent | WT % of Diluent In Charge | Char Fluidity Hot | Char Remainder In Crucible Fluidity When Cold | Char Remainder In Crucible Fluidity When Tapped | Segregation Noted In Charge |
|---|---|---|---|---|---|---|
| PMC | None | 0 | Button | Button | — | None |
| −40 PMC | None | 0 | Button | Button | — | None |
| PMC | −40 m F.C. | 50 | 90% Pours | 10% Pours | — | None |
| PMC | −40 m F.C. | 30 | 50% Pours | Little Pours | 45% Pours | None |
| PMC | −40 m F.C. | 15 | 5% Pours | Little Pours | 5% Pours | None |
| PMC | −40 m F.C. | 5 | Button | Button | — | None |
| PMC | −10 m F.C. | 30 | 20% Pours | Little Pours | 10% Pours | None |
| PMC | −10 m F.C. | 15 | No Fluidity | Little Pours | Little Pours | None |
| PMC | −10 m F.C. | 5 | Button | Button | — | None |
| PMC | Cab-O-Sil | 10 | 100% Pours | — | — | Some |
| PMC | Cab-O-Sil | 5 | 90% Pours | 5% Pours | 5% Pours | None |
| PMC | Cab-O-Sil | 3 | 50% Pours | 10% Pours | 10% Pours | Some |
| PMC | Lime | 50 | 95% Pours | 2% Pours | 3% Pours | Significant |
| PMC | Lime | 40 | 80% Pours | 10% Pours | 10% Pours | Significant |
| PMC | Lime | 20 | Button | Button | — | Significant |
| PMC | −10 m Char | 20 | Partial Button | Button | — | None |
| PMC | −10 m Char | 15 | Partial Button | Button | — | None |
| PMC | −10 m Char | 5 | Button | Button | — | None |
| LC | −40 m F.C. | 65 | 95% Pours | Little Pours | 5% Pours | None |
| LC | −40 m F.C. | 55 | 95% Pours | Little Pours | 5% Pours | None |
| LC | −40 m F.C. | 30 | 90% Pours | Little Pours | Little Pours | None |
| LC | −10 m F.C. | 50 | 95% Pours | 5% Pours | — | None |
| LC | −10 m F.C. | 30 | 85% Pours | 5% Pours | — | None |
| LC | −10 m F.C. | 15 | 10% Pours | Nothing Pours | Nothing Pours | None |
| LC | −10 m F.C. | 5 | Button | Button | Button | None |

PMC - Prince Mine Coal
LC - Lingan coal

It can be seen from Table 1 that the sub-bituminous coal particles represent the most effective caking inhibitors.

EXAMPLE 2

A further series of tests were conducted in which the feed stock was a blend of Prince Mine bituminous coal, Forrestburg sub-bituminous coal and Cab-O-Sil. The proportions of these materials used, the reactor conditions and the results obtained are set out in Table II below.

TABLE II

| Test # | | Test Data for Class 'A' Runs (Successful Runs) 66 | 64 | 60 | 63 |
|---|---|---|---|---|---|
| Prince Mine Coal | % | 57 | 57 | 57 | 57 |
| Forestburg Coal | % | 40 | 40 | 40 | 40 |
| CAB-O-SIL | | 3 | 3 | 3 | 3 |
| React. Heaters 'on' | # | 4 | 4 | 3 | 2 |
| Date | moth.day | 4.11 | 4.03 | 3.21 | 4.01 |
| Duration | min | 76 | 46 | 68 | 65 |
| Reactor pressure | psi | 1800 | 1880 | 1800 | 1800 |
| Reactor pressure | MPa | 12.4 | 13.0 | 12.4 | 12.4 |
| Coal (dry) fed | 9 | 597 | 446 | 610 | 589 |

TABLE II-continued

| Test # | | Test Data for Class 'A' Runs (Successful Runs) 66 | 64 | 60 | 63 |
|---|---|---|---|---|---|
| Coal feed rate | g/h | 472 | 582 | 538 | 544 |
| Hydrogen feed rate | g/h | 1106 | 913 | 1257 | 973 |
| Power into pre-heater | kVA | 3.3 | 3.2 | 3.6 | 2.7 |
| Hydrogen preheat | C. | 725 | 740 | 705 | 680 |
| Heated reactors set to | C. | 800 | 800 | 800 | 800 |
| Gas temp. inside react. | C. | 700 | 715 | # N/A | # N/A |
| Reactor wall #1/#2 | C. | 700 | # N/A | # N/A | # N/A |
| Reactor wall #3/#4 | C. | #N/A | 718 | 640 | 475 |
| Gas discharge temp. | C. | 670 | 665 | 530 | 375 |
| Gas velocity | cm/s | 13 | 10 | 15 | 12 |
| Particle velocity | cm/s | 24 | 28 | 29 | 29 |
| Gas residence time | s | 21 | 26 | 14 | 12 |
| Particle resid. time | s | 7 | 7 | 5 | 3 |
| First liquid trap: | | | | | |
| Organic Liquids | % coal | 5.5 | 3.9 | 6.8 | 3.2 |
| Process water | % coal | 11.7 | 11.9 | 10.3 | 10.2 |
| Solids | % coal | 2.0 | 0.2 | 0.6 | 0.0 |
| Total collected | % coal | 17.4 | 17.8 | 17.7 | 13.5 |
| Second liquid trap: | | | | | |
| Organic Liquids | % coal | 1.6 | 4.5 | 8.3 | 3.8 |
| Process water | % coal | 0.9 | 0.4 | 0.2 | 0.0 |
| Solids | % coal | 0.0 | 0.1 | 0.2 | 0.1 |
| Total collected | % coal | 2.6 | 5.0 | 8.6 | 3.9 |
| Char trap | % coal | 41.8 | 40.0 | 43.2 | 54.7 |
| Organic Liquids | % coal | 7.1 | 8.4 | 15.1 | 7.0 |
| Gaseous HC's | % coal | 37.2 | 42.1 | 31.3 | 26.4 |
| CO & CO2 | % coal | 5.5 | 5.1 | 5.5 | 5.5 |
| Char (total) | % coal | 42.0 | 42.1 | 44.0 | 54.9 |
| Process water | % coal | 12.7 | 12.3 | 10.5 | 10.2 |
| All porducts * | % coal | 104.5 | 110.0 | 106.4 | 104.1 |

A mass balance was also conducted on the runs from Table II above and the results obtained are shown in Table III below.

TABLE III

| Mass Balances for Class "A" Runs | | | | | |
|---|---|---|---|---|---|
| Test # | | 66 | 64 | 60 | 63 |
| Prince Mine Coal | % | 57 | 57 | 57 | 57 |
| Forestburg Coal | % | 40 | 40 | 40 | 40 |
| CAB-O-SIL | % | 3 | 3 | 3 | 3 |
| React. Heaters 'on' | # | 4 | 4 | 3 | 2 |
| Heated reactors set to | C. | 800 | 800 | 800 | 800 |
| Gas temp. inside react. | C. | 700 | 715 | # N/A | # N/A |
| Reactor pressure | psi | 1800 | 1880 | 1800 | 1800 |
| Hydrogen preheat | C. | 725 | 740 | 705 | 680 |
| Gas discharge temp. | C. | 670 | 665 | 530 | 375 |
| Coal feed rate | g/h | 472 | 582 | 538 | 544 |
| Hydrogen feed rate | g/h | 1106 | 913 | 1257 | 973 |
| Coal conv., MAF basis | % coal | 65.1 | 64.6 | 62.7 | 49.2 |
| Hydrogen feed rate | % coal | 234.6 | 157.0 | 233.5 | 179.0 |
| Unreacted H in effluents | % coal | 227.4 | 148.3 | 227.4 | 173.7 |
| H added to products | % coal | 7.3 | 8.7 | 6.1 | 5.3 |
| Coal (dry) | % coal | 100.0 | 100.0 | 100.0 | 100.0 |
| FEED | % coal | 107.3 | 108.7 | 106.1 | 105.3 |
| Organic Liquids | % coal | 7.1 | 8.4 | 15.1 | 7.0 |
| Process water | % coal | 12.7 | 12.3 | 10.5 | 10.2 |
| LIQUID PRODUCTS | % coal | 19.8 | 20.7 | 25.6 | 17.2 |
| Gaseous HC's | % coal | 37.2 | 42.1 | 31.3 | 26.4 |
| CO & CO2 | % coal | 5.5 | 5.1 | 5.5 | 5.5 |
| GASEOUS PRODUCTS | % coal | 42.7 | 47.2 | 36.8 | 31.9 |
| CHAR | % coal | 42.0 | 42.1 | 44.0 | 54.9 |
| ALL PRODUCTS | % coal | 104.5 | 110.0 | 106.4 | 104.1 |
| UNACCOUNTED | % coal | 2.8 | −1.3 | −0.3 | 1.3 |

The above mass balances close within 3 weight %, indicating satisfactory operation.

While we have described particular embodiments of our invention for purposes of illustration, it is understood that other modifications and variations will occur to those skilled in the art, and the invention accordingly is not to be taken as limited except by the scope of the appended claims.

We claim:

1. A process for the flash pyrolysis in a pyrolysis chamber of high rank caking coal in which particles of said coal pass through a sticky plastic state during flash pyrolysis, characterized in that before entering the pyrolysis chamber, the particles of high rank caking coal are blended with a diluent comprising a finely ground non-caking coal having particle sizes of less than 40 microns, whereby the particles of high rank caking coal are coated with said finely ground non-caking coal particles and agglomeration and caking of the high rank coal is thereby prevented during flash pyrolysis.

2. A process according to claim 1 wherein the high rank caking coal is a bituminous coal having particle sizes in the range of about −35 mesh to +150 mesh.

3. A process according to claim 2 wherein the non-caking coal is a partially oxidized coal, a sub-bituminous coal or a lignite.

4. A process according to claim 3 wherein the non-caking coal has particle sizes of less than 10 microns.

5. A process according to claim 3 wherein the blend of caking coal and non-caking coal also contains a small amount of a finely divided inert material.

6. A process according to claim 1 wherein the blend of caking coal and non-caking coal contains about 10 to 50% by weight of the non-caking coal.

7. A process according to claim 6 wherein the blend also contains up to 5% by weight of a finely divided material inert to the pyrolysis process.

8. A process according to claim 7 wherein the finely divided inert material is silica powder.

9. A process according to claim 1 wherein the flash pyrolysis is carried out at a temperature in the range of about 600°–950° C. and a pressure of at least 4.0 MPa.

10. A process according to claim 9 wherein the flash pyrolysis is carried out in the presence of a hydrogen-containing gas.

* * * * *